US005817999A

United States Patent [19]

Mugan et al.

[11] Patent Number: 5,817,999

[45] Date of Patent: Oct. 6, 1998

[54] CIRCUIT BREAKER OPERATING HANDLE LOCKING DEVICE

[75] Inventors: John Michael Mugan, Lisnalurge; Michael Peter Burke, Glentaun; Shay Joseph Lavelle, Westport, all of Ireland

[73] Assignee: Square D Company, Palatine, Ill.

[21] Appl. No.: 586,428

[22] Filed: Jan. 12, 1996

[30] Foreign Application Priority Data

Jan. 13, 1995 [IE] Ireland ..... 950019

[51] Int. Cl.[6] ..... H01H 9/20

[52] U.S. Cl. ..... 200/50.11; 200/43.15; 200/43.16

[58] Field of Search ..... 200/43.01–43.22, 200/50.01–50.4, 318–327

[56] References Cited

U.S. PATENT DOCUMENTS

| | | | |
|---|---|---|---|
| 4,079,214 | 3/1978 | Castonguay et al. | 200/50.15 |
| 4,260,861 | 4/1981 | DiMarco | 200/43.15 |
| 4,270,031 | 5/1981 | Borona et al. | 200/50.33 |
| 4,300,030 | 11/1981 | DiMarco et al. | 200/43.19 |
| 4,882,456 | 11/1989 | Hovanic et al. | 200/43.15 |
| 4,978,816 | 12/1990 | Castonguay et al. | 200/43.14 |
| 5,349,145 | 9/1994 | Kelaita, Jr. et al. | 200/318 X |

*Primary Examiner*—J. R. Scott

*Attorney, Agent, or Firm*—Larry I. Golden; Kareem M. Irfan; Wayne H. Stoppelmoor

[57] ABSTRACT

A locking device is provided for use with a circuit breaker operating handle to selectively keep the handle locked and prevented from moving between ON and OFF positions. The locking device includes a support frame with at least two oppositely directed mounting grips for securing the frame to the circuit breaker housing, and a locking arm movably disposed on support means extending from the support frame for movement between at least first and second engaged positions and a disengaged position. The locking arm prevents the operating handle from moving from the ON position to the OFF position when it is in the first engaged position and prevents the operating handle from moving from the OFF position to the ON position when it is in the second engaged position. A bracket on the support frame receives a locking member for securing the locking arm in either of the one engaged positions.

22 Claims, 5 Drawing Sheets

CIRCUIT BREAKER OPERATING HANDLE LOCKING DEVICE

FIELD OF THE INVENTION

The invention relates to a locking device for a circuit breaker to prevent operation of a circuit breaker operating handle.

In this specification the term 'handle' means a single circuit breaker operating handle, the operating handles of adjacent circuit breakers and/or a handle tie connecting a number of operating handles.

BACKGROUND OF THE INVENTION

It is frequently necessary to ensure that electrical equipment cannot be operated, for example while maintenance work is being carried out. It is essential to ensure that circuit breakers associated with the equipment are secured in the OFF position as if inadvertently operated, personnel may be injured or the equipment damaged. It is also often necessary to ensure that equipment is secured in the ON position, to prevent accidental shutdown of machinery, such as refrigeration equipment, life support systems or equipment with long initialisation time requirements.

A variety of methods to secure operating handles in a desired position have been used, for example by locking a cabinet within which the circuit breakers are housed. It is also known to provide a locking tab mounted within a recess of a multipole circuit breaker housing. However, the locking tabs are difficult to operate and suitable only for multipole devices. It is also known to provide a locking attachment which may be screwed onto the circuit breaker housing. However, such locking attachments may require disconnection of the circuit breaker from the circuit before they can be mounted.

OBJECT OF THE INVENTION

The invention is therefore directed towards providing an improved locking device for locking the operating handle of the circuit breaker in a desired position which will overcome at least some of these disadvantages.

SUMMARY OF THE INVENTION

According to the invention, there is provided a locking device for locking an operating handle of a circuit breaker comprising:

- a support frame;
- at least two oppositely directed mounting grips carried on the support frame, the grips being arranged for engaging a circuit breaker housing to grip the support frame to a circuit breaker housing;
- locking arm support means extending from the support frame; and
- a locking arm movably mounted on the support means, for movement between at least one engaged position preventing operation of the circuit breaker operating handle and a disengaged position.

This advantageously allows the locking device to be retro-fitted to the circuit breaker housing without the need to disconnect the circuit breaker. The locking device may be easily and securely mounted onto the circuit breaker housing for ease of engagement with the operating handle and without obscuring circuit breaker surface detail.

Ideally the locking arm is movable between a disengaged position, an operating handle ON engaged position and an operating handle OFF engaged position. Thus, the operating handle may be securely locked in whichever position is required. The locking device once fitted can remain in-situ on the circuit breaker when not required for use without affecting the normal operation of the handle.

Preferably the locking arm is slidably movable on the support means. This allows the locking arm to be easily moved between the disengaged, engaged ON and engaged OFF positions.

Preferably the locking arm is pivotally movable on the support means.

In a preferred arrangement the locking arm is pivotally and slidably movable on the support means. In this way, the locking arm may be easily moved between the various positions by moving the arm pivotally and slidably on the locking arm support, the amount of movement may also advantageously be varied and accordingly, circuit breakers having operating handles with a variety of turning angles, or angles of operation even turning angles circuit breakers with very small areas of operation may be accommodated.

Ideally at least one grip includes a lug portion of a deformable material which is movable to an extended position to engage a circuit breaker housing. Thus, the locking device may be securely mounted onto the existing recesses of the circuit breaker housing by simple movement of the lug portion to the extended position.

In one arrangement at least one grip is flexible for snap-fit engagement with a circuit breaker housing. Thus, when it is required to secure the locking device to a circuit breaker housing, it may be achieved in a quick and efficient manner.

Preferably the support frame comprises at least two spaced-apart elongate side members and interconnecting and members, the grips being provided on the end members. The support frame is therefore stable on the circuit breaker housing with the side members arranged on either side of the operating handle. The use of a frame in this way has the further advantage of not obscuring surface detail on the circuit breaker housing making the device safer to use by non-obstruction of safety notices.

Preferably the locking device incorporates securing means to prevent operation of a circuit breaker operation handle, the securing means being provided by complimentary frictionally interengageable formations on the locking arm and a locking bracket carried on the support frame. Thus the locking arm does not move excessively and the frictional engagement allows the locking arm to be held in a transient position between the locked ON and locked OFF positions.

In one embodiment the locking arm has:

- a locking head for engaging a circuit breaker operating handle,
- a mounting section for engaging the locking arm support means,
- and a locking section between the locking head and the mounting section having an aperture for receiving a locking bracket extending from the support frame.

This advantageously provides a very strong locking arm and allows the locking arm to be securely locked in position ensuring that the locking arm cannot disengage from the locking bracket if the hasp of a security lock is passed through.

Preferably the locking arm support means includes at least one support bracket carried on the support frame, the support bracket having an elongate groove for receiving the locking arm. This allows the required pivotal and slidable movement to be achieved in a relatively simple manner by mounting one end of the locking arm in the groove thereby ensuring the required range of movement and securely mounting the locking arm.

Ideally the locking arm terminates at each end in a locking lug and the locking arm support means includes a pair of spaced-apart support brackets carried on the support frame, the support brackets each having an elongate groove for receiving a locking lug. Positioning the locking arm between the support brackets prevents it becoming detached accidentally as the lugs extending through the cut-away groove prevent excessive movement of the arm.

Preferably the support frame has reinforcing means to prevent torsional distortion of the support frame.

Ideally the support frame comprises at least two spaced-apart elongate side members and interconnecting and members and an inwardly extending mounting plate extending between at least one end member and one elongate side member of the support frame. Thus the structural strength of the device is provided without using large amounts of materials. This reduces production costs and further, does not obscure circuit breaker housing detail.

Preferably the locking arm support means extends from the mounting plate. This allows the device to be formed by folding the support means from a single metal blank thereby reducing production costs.

Preferably the locking arm support means comprises a locking bracket, the locking bracket defining a lock receiving hole, the bracket being mounted on an extending upwardly from the support frame. This allows the locking device to be produced from a single blank and allows the locking device to remain in position until removed by an authorised person.

Preferably the locking arm support means comprises a pair of locking arm support brackets mounted on the support frame.

Ideally the locking bracket is disposed between and forward of the locking arm support brackets. This allows the locking bracket to be used to engage the locking arm to provide the desired frictional contact and In a preferred embodiment, the support frame and grips are integrally formed.

In one arrangement, the support frame is integrally formed with the circuit breaker housing. This ensures that the locking device is in position available for use at all times.

Ideally the grips are formed from a resilient material for demountably securing the locking device on the circuit breaker housing. This allows the locking device to be provided in a manner suitable for snap-fit engagement with one circuit breaker and to be subsequently removed for engagement with another circuit breaker if required.

In one embodiment the locking device is formed from plastics material for snap-fit engagement with a circuit breaker housing, advantageously mounting the device on the circuit breaker in a relatively simple manner.

According to one aspect of the invention there is provided a circuit breaker having:

- an operating handle extending outwardly from a circuit breaker housing front plate;
- the front plate being terminated at either end in a stepped portion;
- each stepped portion having at least one recess for receiving a locking device support frame;
- the support frame having locking arm support means extending from the support frame and a locking arm movably mounted on the support means for movement between at least one engaged position thereby preventing operation of the circuit breaker operating handle and a disengaged position.

The invention will be more clearly understood from the following description of three embodiments thereof, given by way of example only with reference to the accompanying drawings.

DETAILED DESCRIPTION OF PREFERRED EMBODIMENTS

Figure 1:
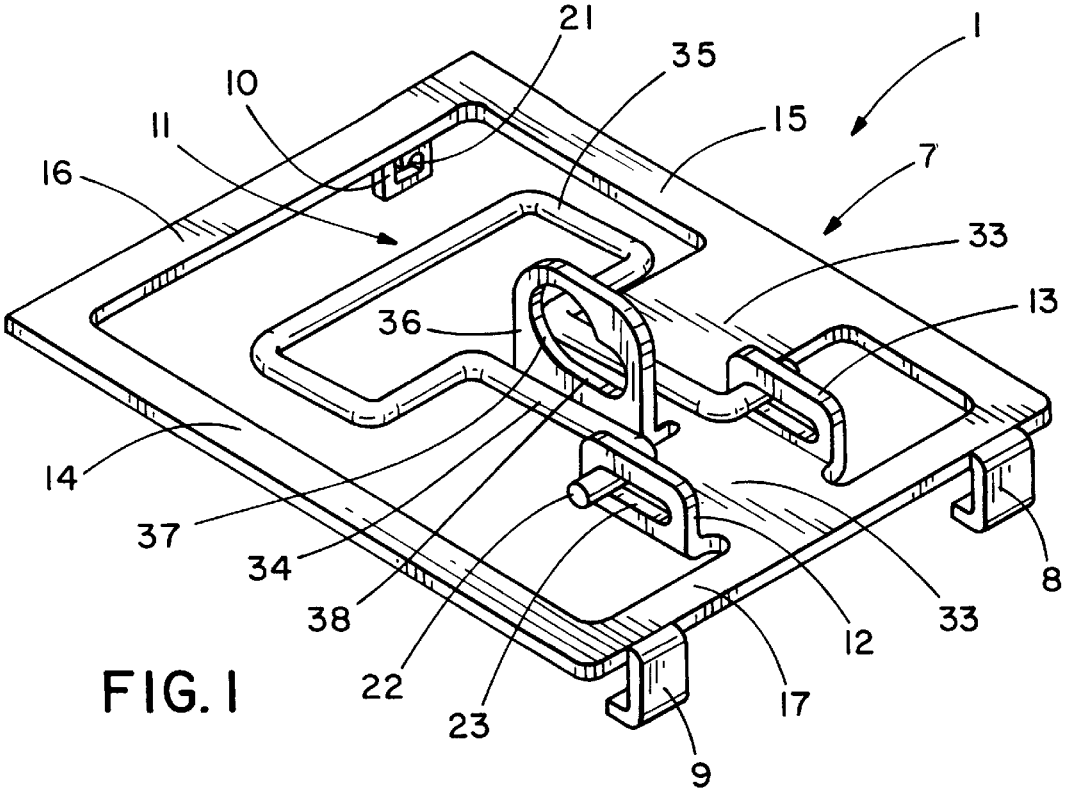
FIG. 1 is a perspective view from above of a locking device according to the invention.

Referring to the drawings and initially to FIGS. 1 to 6, there is illustrated a locking device according to the invention indicated generally by the reference numeral 1 for a circuit breaker 2 of the type having a circuit breaker front face 3, an operating handle 4 projecting from the face 3, and a circuit breaker housing 5 having two stepped portions 6, one portion on either side of the circuit breaker front face 3.

The locking device 1 comprises a support frame 7 having mounting grips 8,9, oppositely directed grip 10 and a locking arm 11. The locking arm 11 is provided at the free ends thereof with outwardly extending mounting lugs 22 which engage in elongate grooves 23 in two locking arm support brackets 12, 13. The brackets 12, 13 extend upwardly from a mounting plate 33 which extends inwardly from one side of the support frame 7, this positions the locking arm support brackets 12, 13 inboard of the support frame 7, thereby strengthening the locking device 1. The locking arm 11 mounted on the support brackets 12 by the mounting lugs 22 and the elongate grooves 23 has a narrowed locking section 34 and an enlarged head section 35.

The mounting plate 33 also provides a support on which a locking bracket 36 having a lock receiving hole 37 is mounted. In this case the locking bracket 36 is provided by an upturned portion of the mounting plate 33. The locking bracket 36 is located in the narrowed locking section 34 of the locking arm 11 and forward of the support brackets 12, 13 thereby minimising movement between the hasp of a security lock (not shown) and the locking arm 11, in use.

It will be noted that the lock receiving hole 37 of the locking bracket 36 has an asymmetric portion 38 for receiving a safety lockout device such as the one available from Hoffman Engineering Company of Anoka, Minnesota as Catalog Number A-SL6. This allows the locking device 1 to accommodate a number of security locks or a security lock having a hasp which is larger than the lock receiving hole 37.

In more detail, the support frame 7 in this case is of generally rectangular shape having two spaced-apart elongate side members 14,15 and interconnecting end members 16,17. The mounting grips extend inwardly from the end members 16,17 to engage corresponding recesses 18,19,20 of the circuit breaker housing 5. The grip 10 has a movable lug 21 which is movable by bending from the release position of FIGS. 1 and 2 to the locked position illustrated in FIG. 6 in which the lug 21 is engaged in the recess 18 of the circuit breaker housing 5.

Figure 4:
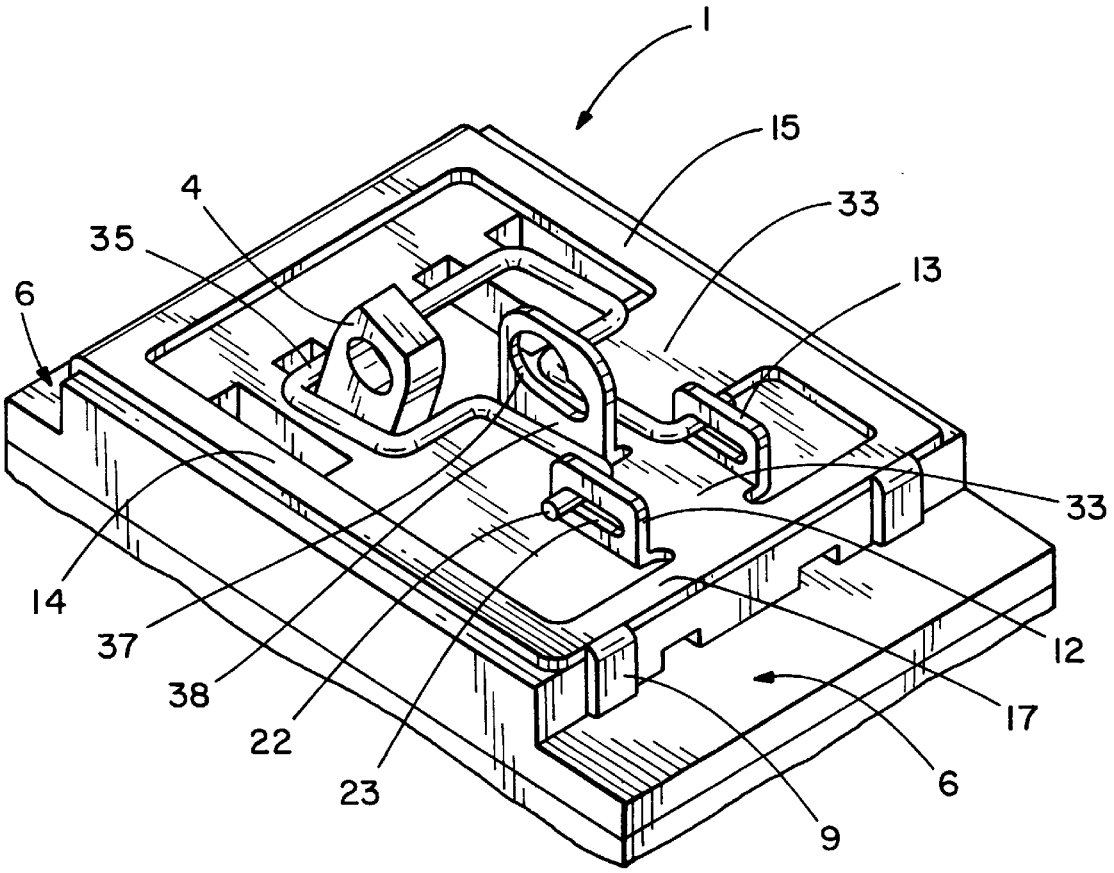
FIG. 4 is a perspective view of the device of FIG. 1 in position on a circuit breaker in a locked OFF position.
Figure 5:
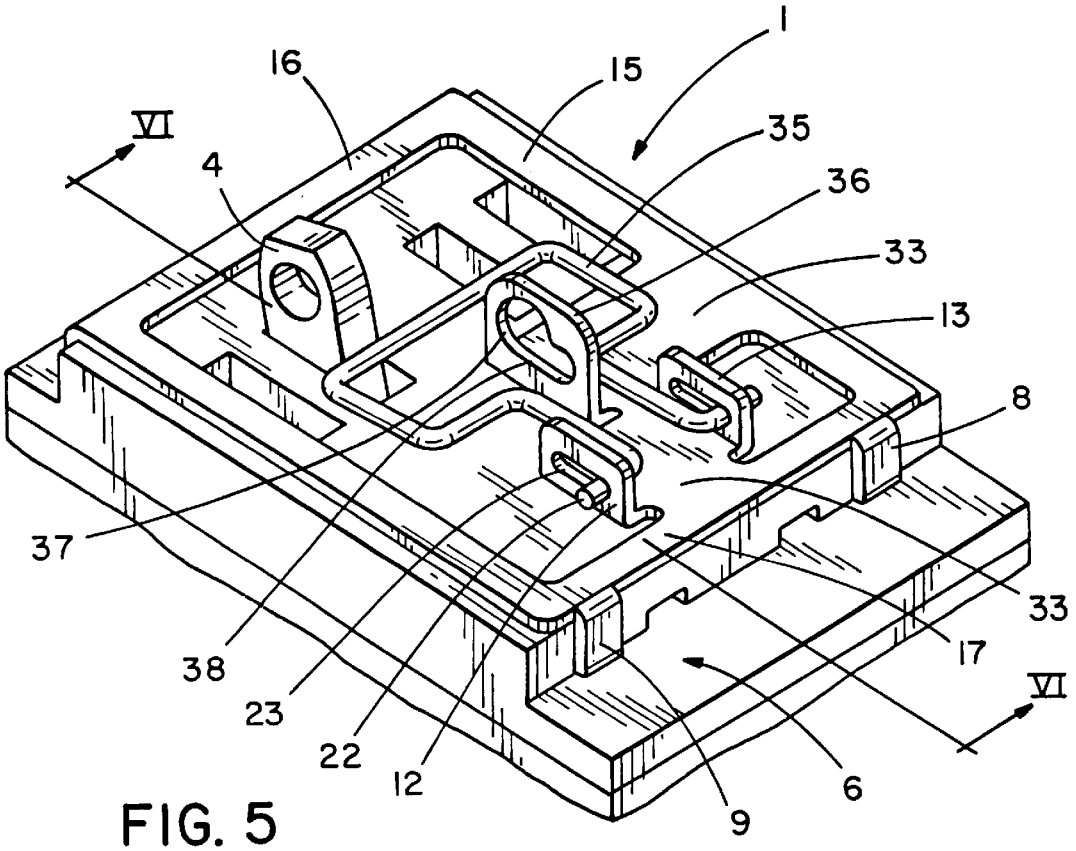
FIG. 5 is a perspective view of the device of FIG. 1 in position on a circuit breaker in a locked ON position.

The locking arm 11 is pivotally and slidably movable along and about the cut-away grooves 23 between a disengaged position (not shown), an operating handle ON engaged position as illustrated particularly in FIG. 5 and an operating handle OFF engaged position as shown in FIG. 4.

Figure 2:
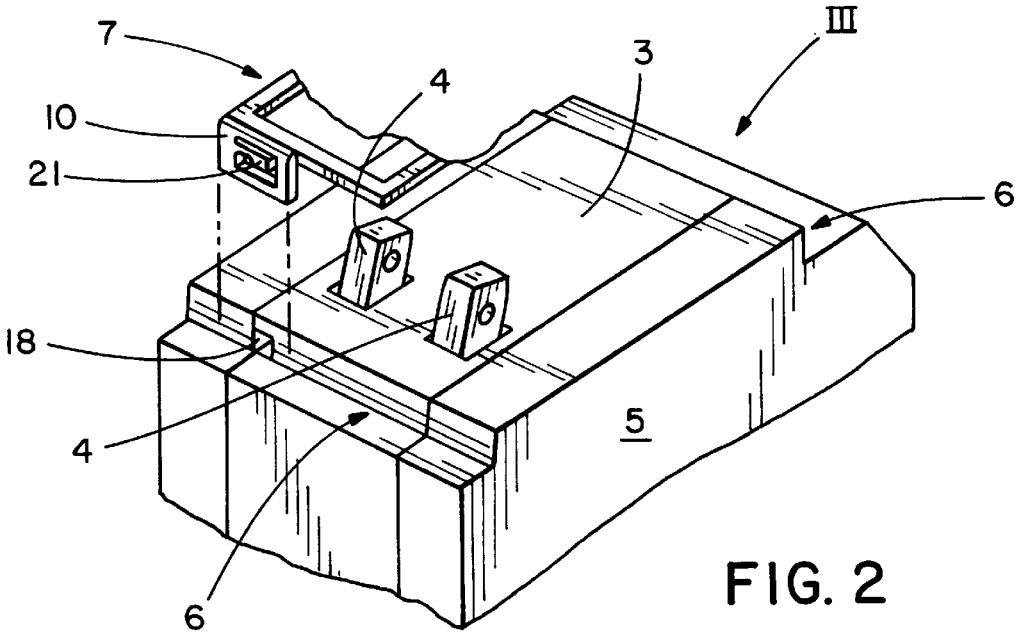
FIG. 2 is an exploded perspective view showing a portion of the locking device of FIG. 1 in position for fitting to a circuit breaker.
Figure 3:
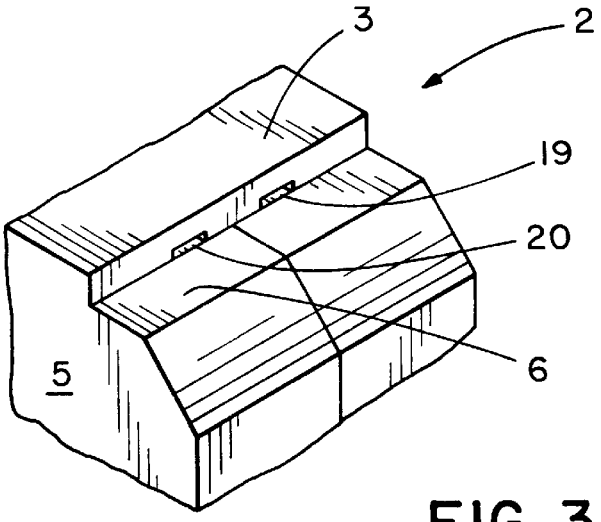
FIG. 3 is a perspective view in the direction of the arrow III of FIG. 2 of portion of the circuit breaker.

In use, when required to prevent operation of the circuit breaker operating handles 4 the locking device 1 is positioned so that the grips 8, 9 are aligned with the associated recesses 19 and 20 respectively as shown in FIG. 2. The grips 8, 9 are engaged with the recesses 19, 20 and the mounting frame 7 is pivoted until the grip 10 coincides with the recess 18. The movable lug 21 is then bent inwardly to engage the recess 18 and thereby fix the locking device 1 in position on the circuit breaker housing 5 with the support frame 7 flat against the front face 3.

Figure 6:
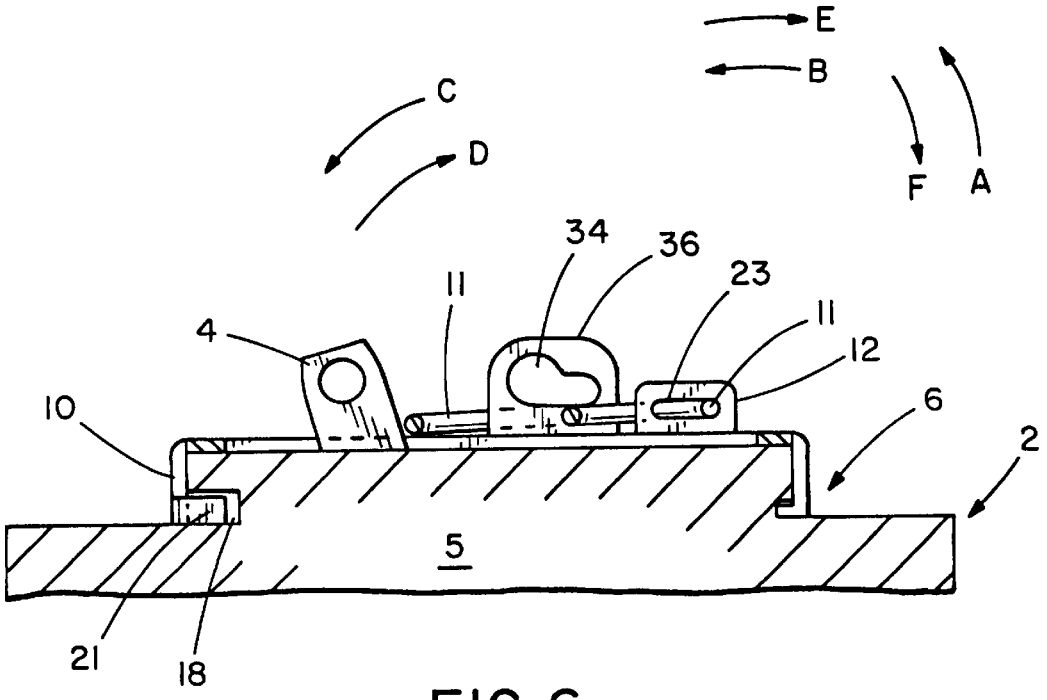
FIG. 6 is a partial cross sectional view in the direction of the arrows VI—VI of FIG. 5.
Figure 7:
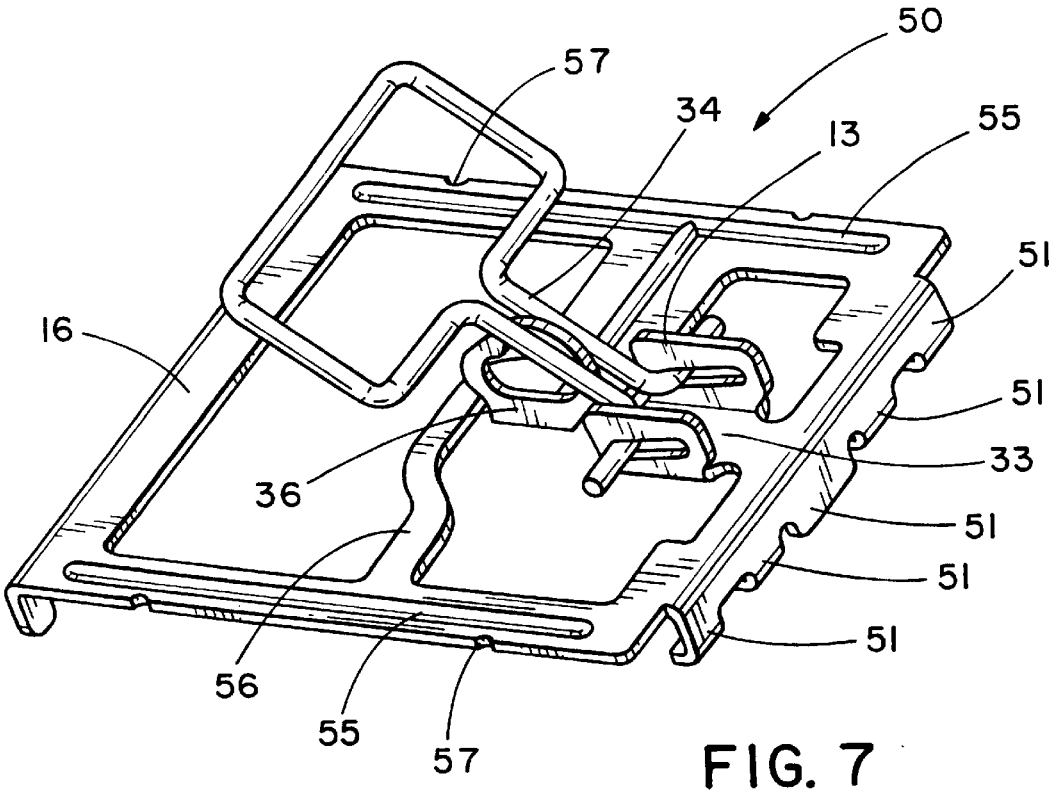
FIG. 7 is a perspective view of an alternative locking device according to the invention showing the locking arm in a disengaged position.
Figure 8:
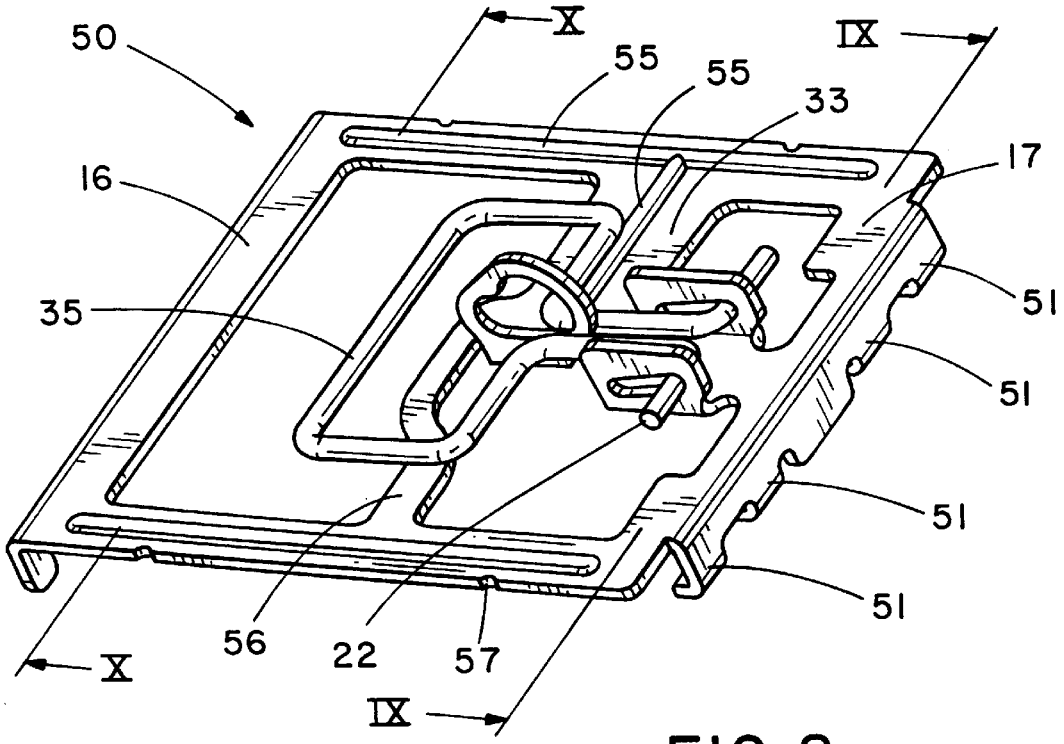
FIG. 8 is a perspective view similar to FIG. 7 showing the locking arm in an engaged position.
Figure 9:
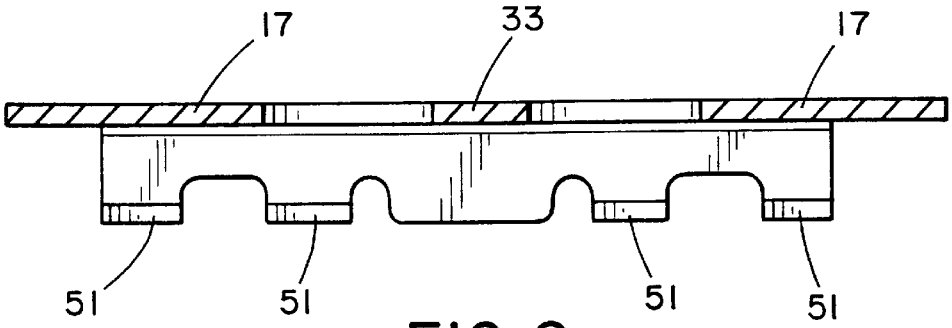
FIG. 9 is a sectional of the locking device of FIG. 8 in the direction of the arrows IX—IX.
Figure 10:
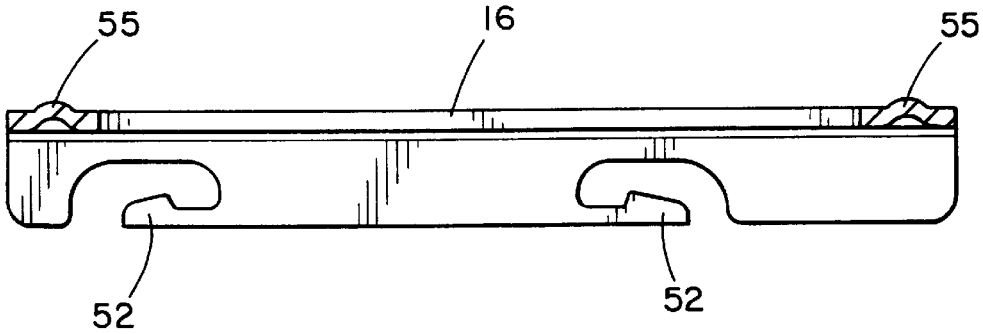
FIG. 10 is a sectional view similar to FIG. 9 in the direction of the arrows X—X.

Referring particularly to FIG. 6, to lock the circuit breaker operating handles 4 in an operating handle OFF engaged position as illustrated particularly in FIG. 4, the circuit breaker operating handles 4 are first moved to the OFF engaged position. The locking arm 11 is then pivoted away from the circuit breaker housing 5 in the direction of the arrow A and then slidably moved along the cut-away groove 23 in the direction of the arrow B passing over the circuit breaker operating handles 4. The locking arm 11 is then pivoted towards the circuit breaker housing 5 as shown by the arrow C.

When the locking bracket 36 has passed through the narrowed locking section 34 of the locking arm 11 past the lock receive hole 37 and the enlarged head section 35 has engaged the circuit breaker operating handles 4, the hasp of the lock is passed through the hole 34 and secured. The lock prevents pivotal movement of the locking arm 11 and longitudinal movement of the locking arm 11 is prevented by the circuit breaker operating handles 4 wedging the locking arm 11 against one end of the cut-away groove 23. In this way operation of the circuit breaker operating handles 4 is prevented.

When it is desired to lock the circuit breaker operating handles 4 in an operating handle ON engaged position as illustrated particularly in FIGS. 5 and 6 the security lock is removed from the hole 37 and the locking arm 11 is disengaged from the circuit breaker operating handles 4 by pivoting the locking arm 11 away from the circuit breaker housing 5 in the direction of the arrow D (FIG. 6). The circuit breaker operating handles 4 are then operated to the ON position and the locking arm 11 is slidably moved along the cut-away groove 23 in the direction of the arrow E and passed over the circuit breaker operating handles 4. The locking arm 11 is then pivoted towards the circuit breaker housing 5 in the direction of the arrow C. When the locking arm 11 has passed the hole 37 and has engaged the circuit breaker operating handles 4 the hasp of the lock is passed through the hole 37 and secured as described above. Pivotal movement of the locking arm 11 is again prevented by the security lock and longitudinal movement is prevented as the locking arm 11 is wedged against the opposite extremity of the cut-away groove 23.

To disengage the locking device 1, the security lock is removed and the locking arm 11 is pivoted fully away from the operating handles 4.

Referring now to FIGS. 7 to 10 there is illustrated another locking device according to the invention indicated generally by the reference numeral 50. Parts similar to those described with reference to FIGS. 1 to 6 are identified by the same reference numerals.

In this case the grips are provided by four fixed grips 51 and two deformable grips 52.

The elongate side members 14,15 each have a raised portion 55 running along part of their length and onto the mounting plate 33 to prevent torsional deformation of the device 50. The support frame 7 is further strengthened by a reinforcing rib 56 connecting the side member 14 and the mounting plate 33.

The side members 14,15 each have two recesses 57 for engagement by a gripping device during manufacture.

The operation at the locking device 50 is similar to that described with reference to FIGS. 1 to 6. It will be noted that the clearance between the narrowed locking section 34 and the locking bracket 36 is reduced to provide a friction fit engagement between the arm 11 and the bracket 36. This ensures that the locking arm 11 does not rattle when in transit or when engaged on the circuit breaker.

Additionally the distance between the support brackets 12,13 is reduced ensuring that the locking lugs 22 extend well into the cut-away groove 23 to prevent the locking arm 11 becoming accidentally detached from the brackets 36. The lock receiving hole 37 of the locking bracket 36 has the asymmetric portion 38 positioned away from the mounting plate 33 so that when a gangling arrangement is positioned on the device it does not obstruct the mechanism.

Figure 11:
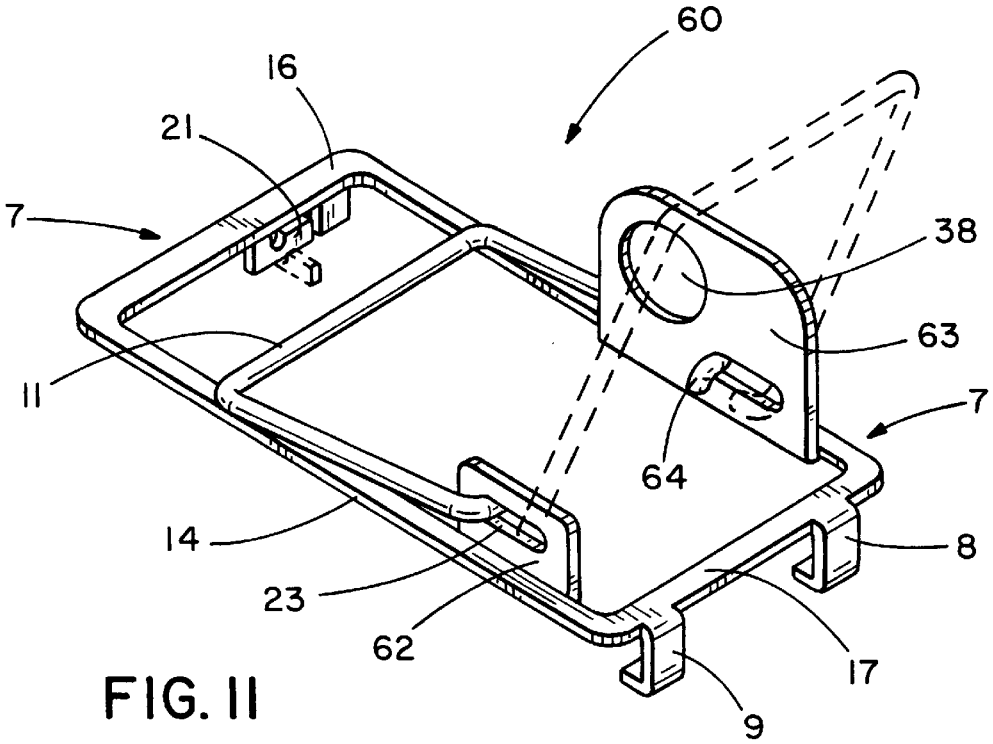
FIG. 11 is a perspective view of a further locking device according to the invention.

Referring now to FIG. 11 there is illustrated another locking device according to the invention indicated generally by the reference numeral 60. Parts similar to those described with reference to FIGS. 1 to 6 are identified by the same reference numerals.

In this arrangement the locking arm 11 is mounted on two locking arm support brackets 62, 63 extending from the support frame 7. The locking arm support brackets 62, 63 are carried on the side members 16, 17 and have an elongate cut-away groove 23 for receiving an inwardly extending locking lug 64. In addition to supporting the locking arm 11 the support bracket 63 also defines the lock receiving hole 38.

It will be appreciated that the locking device described in the above arrangements is particularly useful when it is required to lock a circuit breaker operating handle in either the ON or OFF engaged positions. It will also be appreciated that the locking device may be left in-situ on a circuit breaker when in the disengaged position, without hindering use and without obscuring circuit breaker surface detail.

It will also be appreciated that the locking device described is suitable for engaging operating handles of various sizes and shapes. The movement of the locking arm described is particularly useful for circuit breakers having operating handles with a relatively small turning are between the ON and OFF position. The range of movement of the locking arm may be modified to accommodate circuit breakers having operating handles with a variety of turning arcs. The locking device may also be modified to lock the operating handle of a single pole device.

It will also be further appreciated that the support means may be provided by a support member with grips at either end and that the locking arm may be modified to use a single support tab.

It is envisaged that the grips may be adjustably mounted on the support frame to allow the locking device to be retro-fitted to a wide range of existing circuit breakers. It is also envisaged that the mounting frame may be adjustable to accommodate different applications.

It will be apparent that the locking arm may be of any suitable shape, for example, constructed as a T-shaped locking member passing between handles of adjacent circuit breakers. A locking arm of this type may be adjustable in length and may have an extendable operating handle engaging portion to accommodate a number of different circuit breakers.

Similarly, the narrowed locking section may be provided as a flattened plate section with a cut away groove through which the locking bracket projects when in position. The groove being of sufficient length to ensure that the locking bracket may be received in both engaged ON and engaged OFF positions. Alternatively the flattened plate may have two distinct apertures for receiving the locking bracket in each position.

It will be similarly apparent that the support brackets may be provided by upturned sections of the support frame.

It will be apparent that the locking device may be of any suitable material of construction, for example the mounting frame and locking arm support brackets may be injection moulded from a plastics material or of a suitably machined metal.

It will be appreciated that one or more grips may be flexible and formed for snap fit engagement with the circuit breaker housing.

Many variations on the specific embodiment of the invention described will be readily apparent and accordingly the invention is not limited to the embodiments hereinbefore described, which may be varied in both construction and detail.

What is claimed is:

1. A locking device for use on a circuit breaker having a housing and an operating handle movable between an ON position and an OFF position, the locking device comprising:

a support frame;

at least two oppositely directed mounting grips carried on the support frame, the grips being arranged for engaging the housing to grip the support frame to the housing;

locking arm support means extending from the support frame;

a locking arm movably disposed on the support means, for movement between at least first and second engaged positions and a disengaged position, wherein the locking arm prevents the operating handle from moving from the ON position to the OFF position when the locking arm is in the one engaged position and prevents the operating handle from moving from the OFF position to the ON position when the locking arm is in the second engaged position; and a bracket, disposed on the support frame having an aperture for receiving a locking member for securing the locking arm in either of the engaged positions.

2. A locking device as claimed in claim 1 wherein the locking arm is disposed in slots disposed in the support means and capable of sliding within the slots.

3. A locking device as claimed in claim 1 wherein the locking arm is disposed in slots disposed in the support means and capable of pivoting within the slots.

4. A locking device as claimed in claim 1 wherein the locking arm is disposed in slots disposed in the support means and capable of pivoting and sliding within the slots.

5. A locking device as claimed in claim 1 wherein at least one grip includes a lug portion of a deformable material which is movable to an extended position to engage a circuit breaker housing.

6. A locking device as claimed in claim 1 wherein at least one grip is flexible for snap-fit engagement with a circuit breaker housing.

7. A locking device as claimed in claim 1 wherein the support frame comprises at least two spaced-apart elongate side members and interconnecting end members, the grips being provided on the end members.

8. A locking device as claimed in claim 1 incorporating securing means to prevent operation of a circuit breaker operation handle, the securing means being provided by complimentary frictionally interengageable formations on the locking arm and a locking bracket carried on the support frame.

9. A locking device as claimed in claim 1 wherein the locking arm has:

a locking head for engaging a circuit breaker operating handle, a mounting section for engaging the locking arm support means, and a locking section between the locking head and the mounting section having an aperture for receiving a locking bracket extending from the support frame.

10. A locking device as claimed in claim 1 wherein the locking arm support means includes at least one support bracket carried on the support frame, the support bracket having an elongate groove for receiving the locking arm.

11. A locking device as claimed in claim 1 wherein the locking arm terminates at each end in a locking lug and the locking arm support means includes a pair of spaced-apart support brackets carried on the support frame, the support brackets each having an elongate groove for receiving a locking lug.

12. A locking device as claimed in claim 1 wherein the support frame has reinforcing means for preventing torsional distortion of the support frame.

13. A locking device as claimed in claim 1 wherein the support frame comprises at least two spaced-apart elongate side members and interconnecting end members and an inwardly extending mounting plate extending between at least one end member and one elongate side member of the support frame.

14. A locking device as claimed in claim 1 wherein the locking arm support means extends from the mounting plate.

15. A locking device as claimed in claim 1 wherein the locking arm support means comprises a locking bracket, the locking bracket defining a lock receiving hole, the bracket being mounted on and extending upwardly from the support frame.

16. A locking device as claimed in claim 1 wherein the locking arm support means comprises a pair of locking arm support brackets mounted on the support frame.

17. A locking device as claimed in claim 16 wherein the locking bracket is disposed between and forward of the locking arm support brackets.

18. A locking device as claimed in claim 1 wherein the support frame and grips are integrally formed.

19. A locking device as claimed in claim 1 wherein the grips are formed from a resilient material for demountably securing the locking device on the circuit breaker housing.

20. A locking device as claimed in claim 1 wherein the locking device is formed from plastics material for snap-fit engagement with a circuit breaker housing.

21. A circuit breaker comprising:

an operating handle, extending outwardly from a circuit breaker housing front plate, movable between an ON position and an OFF position;

the front plate being terminated at either end in a stepped portion;

each stepped portion having at least one recess for receiving a grip member disposed on a locking device support frame;

the support frame having i) locking arm support means extending from the support frame, ii) a locking arm movably mounted on the support means for movement between at least one engaged position and a disengaged position, wherein the locking arm prevents the operating handle from moving between the ON position and the OFF position when the locking arm is in the one engaged position and iii) a bracket, disposed on the support frame, having an aperture therein capable of receiving a locking member for securing the locking arm in the one engaged position.

22. A locking device for use on a circuit breaker having a housing and an operating handle movable between an ON position and an OFF position, the locking device comprising:

a support frame;

at least two oppositely directed mounting grips disposed on the support frame, the grips being arranged for engaging the housing to grip the support frame thereto;

locking arm support means extending from the support frame; and a locking arm movably disposed on the support means, for movement between at least one engaged position and a disengaged position, wherein the locking arm prevents the operating handle from moving between the ON position and the OFF position when the locking arm is in the one engaged position, wherein the locking arm comprises:

a locking head for engaging the operating handle;

a mounting section for engaging the locking arm support means; and a locking section between the locking head and the mounting section having an aperture for receiving a locking bracket extending from the support frame.

* * * * *